US009152166B2

(12) United States Patent
Saito et al.

(10) Patent No.: US 9,152,166 B2
(45) Date of Patent: Oct. 6, 2015

(54) ACCELERATOR APPARATUS FOR VEHICLE

(71) Applicant: DENSO CORPORATION, Kariya, Aichi-pref. (JP)

(72) Inventors: Takehiro Saito, Anjo (JP); Masahiro Makino, Kariya (JP)

(73) Assignee: DENSO CORPORATION, Kariya (JP)

( * ) Notice: Subject to any disclaimer, the term of this patent is extended or adjusted under 35 U.S.C. 154(b) by 33 days.

(21) Appl. No.: 14/045,374

(22) Filed: Oct. 3, 2013

(65) Prior Publication Data

US 2014/0096639 A1 Apr. 10, 2014

(30) Foreign Application Priority Data

Oct. 4, 2012 (JP) ..... 2012-222056

(51) Int. Cl.
*G05G 1/30* (2008.04)
*G05G 1/44* (2008.04)

(52) U.S. Cl.
CPC ..... *G05G 1/44* (2013.01); *Y10T 74/20534* (2015.01)

(58) Field of Classification Search
USPC ..... 74/512, 513, 514, 560
See application file for complete search history.

(56) References Cited

U.S. PATENT DOCUMENTS

| | | | | |
|---|---|---|---|---|
| 6,289,762 | B1 * | 9/2001 | Silva | 74/513 |
| 2004/0200309 | A1 * | 10/2004 | Hasegawa et al. | 74/513 |
| 2006/0117902 | A1 * | 6/2006 | Martin et al. | 74/512 |
| 2007/0240534 | A1 | 10/2007 | Makino | |
| 2010/0294074 | A1 * | 11/2010 | Muraji et al. | 74/514 |
| 2012/0011958 | A1 | 1/2012 | Kihara | |
| 2012/0221220 | A1 | 8/2012 | Yamazaki et al. | |
| 2012/0297920 | A1 * | 11/2012 | Saito et al. | 74/513 |
| 2013/0091977 | A1 | 4/2013 | Fukushima et al. | |

FOREIGN PATENT DOCUMENTS

JP 2004-90755 3/2004

OTHER PUBLICATIONS

Office Action (2 pages) dated Aug. 26, 2014, issued in corresponding Japanese Application No. 2012-222056 and English translation (3 pages).

* cited by examiner

*Primary Examiner* — Vicky Johnson
(74) *Attorney, Agent, or Firm* — Nixon & Vanderhye PC

(57) ABSTRACT

A first coil spring urges a shaft in an accelerator closing direction. A support member has a space, in which a first center line of the first coil spring is convexly curved when the shaft is rotated in an accelerator opening direction. The first center line is straight or is convexly curved toward the space when the limiting portion contacts the support member.

6 Claims, 5 Drawing Sheets

ACCELERATOR APPARATUS FOR VEHICLE

CROSS REFERENCE TO RELATED APPLICATION

This application is based on and incorporates herein by reference Japanese Patent Application No. 2012-222056 filed on Oct. 4, 2012.

1. Technical Field

The present disclosure relates to an accelerator apparatus for a vehicle.

2. Background

An accelerator apparatus controls an acceleration state of a vehicle based on the amount of depression of an accelerator pedal (also referred to as a gas pedal) that is depressed by a foot of a driver of the vehicle. The accelerator pedal is urged by a spring(s) in an accelerator closing direction. For example, JP2004-090755A recites an accelerator apparatus, which includes two return springs that urge the accelerator pedal in the accelerator closing direction.

However, in the accelerator apparatus of JP2004-090755A, the return springs are arcuately curved to protrude in a radially outer direction of a rotational axis of the accelerator pedal at the time of fully closing an accelerator, i.e., at the time of fully releasing the pedal. Therefore, a size of a housing of the accelerator apparatus is disadvantageously increased in the protruding direction of the return springs.

SUMMARY

The present disclosure is made in view of the above points. According to the present disclosure, there is provided an accelerator apparatus for a vehicle, including a support member, a shaft, a first boss portion, a depressible portion, a limiting portion, a rotational angle sensing device and a first coil spring. The support member is installable to a body of the vehicle. The shaft is supported by the support member and is rotatable in an accelerator opening direction and an accelerator closing direction, which are opposite to each other. The first boss portion is fixed to an outer peripheral wall of the shaft and is rotatable integrally with the shaft. The depressible portion is connected to the first boss portion and is depressible by a driver of the vehicle. The limiting portion is connected to the first boss portion. The limiting portion limits a rotational angle of the shaft in the accelerator closing direction when the limiting portion contacts the support member. The rotational angle sensing device senses the rotational angle of the shaft relative to the support member. The first coil spring urges the shaft in the accelerator closing direction. The support member has a space, in which a first center line of the first coil spring is convexly curved when the shaft is rotated in the accelerator opening direction. The first center line is straight or is convexly curved toward the space when the limiting portion contacts the support member.

BRIEF DESCRIPTION OF THE DRAWINGS

The drawings described herein are for illustration purposes only and are not intended to limit the scope of the present disclosure in any way.

DETAILED DESCRIPTION

Figure 1:
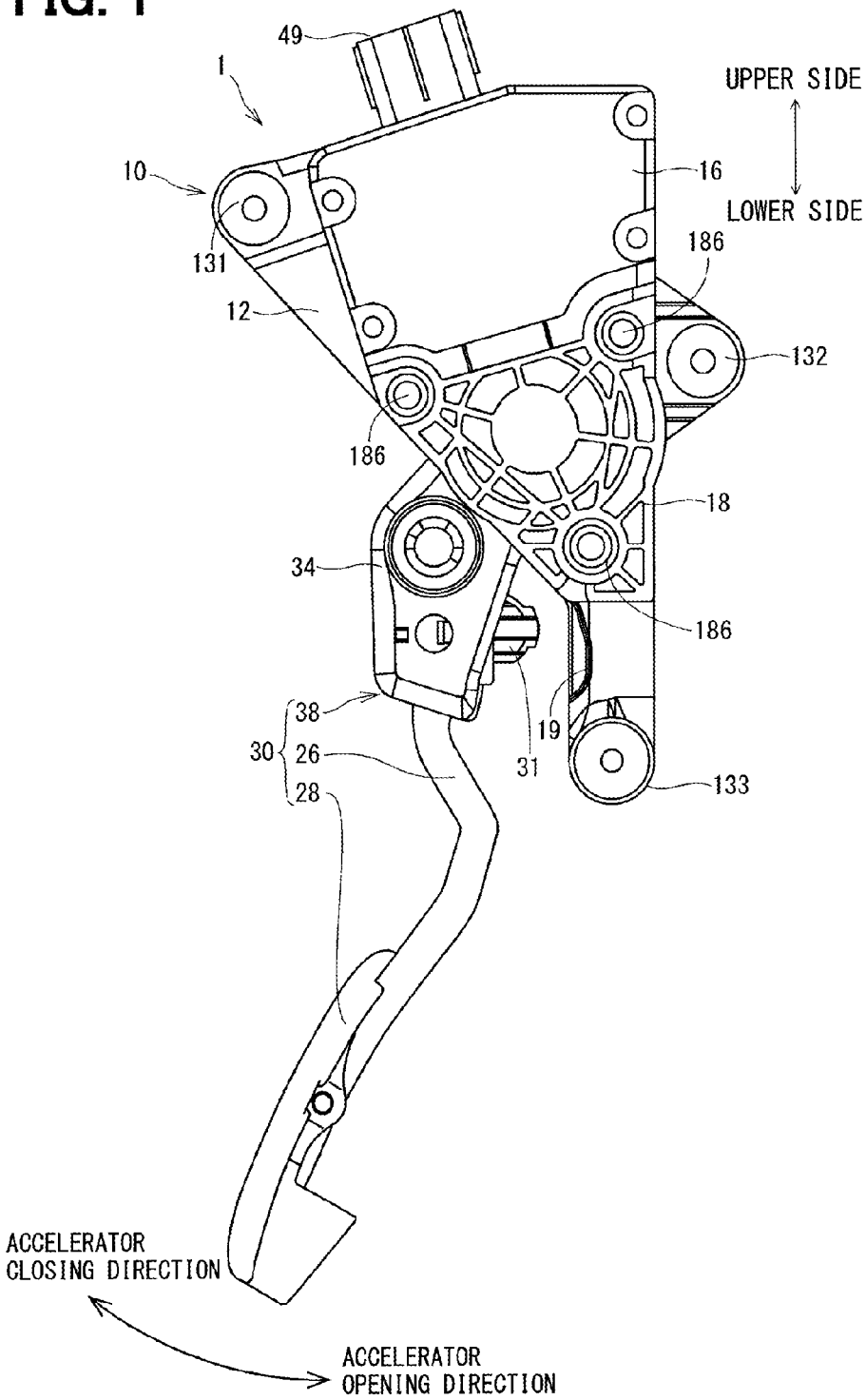
FIG. 1 is a lateral view of an accelerator apparatus according to a first embodiment of the present disclosure.

Various embodiments of the present disclosure will be described with reference to the accompanying drawings.

First Embodiment

FIGS. 1 to 4 show an accelerator apparatus according to a first embodiment of the present disclosure. The accelerator apparatus 1 is an input apparatus, which is manipulated by a driver of a vehicle (e.g., an automobile) to determine a valve opening degree of a throttle valve of an internal combustion engine of the vehicle. The accelerator apparatus 1 is of an electronic type that transmits an electrical signal, which indicates the amount of depression of an accelerator pedal 28 by the foot of the driver of the vehicle, to an electronic control device. The electronic control device drives the throttle valve through a throttle actuator (not shown) based on the amount of depression of the pedal 28 and the other information.

The accelerator apparatus 1 includes a support member 10, a shaft 20, a manipulation member 30, a return spring 39, a rotational angle sensor (serving as a rotational angle sensing device) 40 and a hysteresis mechanism 50. In the following description, an upper side of FIGS. 1 to 4B will be described as an upper side of the accelerator apparatus 1, and a lower side of FIGS. 1 to 4B will be described as a lower side of the accelerator apparatus 1.

The support member 10 includes a housing 12, a first cover 16 and a second cover 18. The support member 10 forms an internal space 11, which receives the shaft 20, the return sprig 39, the rotational angle sensor 40 and the hysteresis mechanism 50. A communication hole 111 is formed at a lower portion of the support member 10 to communicate between the internal space 11 of the support member 10 and an exterior space of the support member 10. The communication hole 111 corresponds to a movable range of the manipulation member 30, which will be described later.

The housing 12 is made of a resin material and includes a bearing segment 13, a front segment 17, a rear segment 15 and a top segment 14. The bearing segment 13 rotatably supports one end portion 201 of the shaft 20. The front segment 17 is connected to the bearing segment 13 and is located at a front side of the accelerator apparatus 1. The rear segment 15 is opposed to the front segment 17. The top segment 14 is located at a top side of the accelerator apparatus 1 and connects the bearing segment 13, the front segment 17 and the rear segment 15 together. Protrusions and recesses, which are configured into a mesh pattern, are formed in an outer wall of the bearing segment 13, an outer wall of the front segment 17, an outer wall of the rear segment 15 and an outer wall of the top segment 14 to maintain the resistivity against an external force applied to the housing 12.

The bearing segment 13 has an opening, which receives the one end portion 201 of the shaft 20. The one end portion 201 of the shaft 20 is rotatably received in this opening of the bearing segment 13. Specifically, the inner wall of the opening of the bearing segment 13 forms a bearing 130, which rotatably supports the one end portion 201 of the shaft 20.

The housing 12 has installation portions 131-133. A bolt hole is formed in each of the installation portions 131-133. The accelerator apparatus 1 is installed to a body 5 of the vehicle by bolts, which are received through the bolt holes, respectively, of the installation portions 131, 132, 133.

A full-opening-side stopper portion 19, which is a recess, is formed in the lower side of the rear segment 15. When a full-opening-side stopper 31, which is formed as a protrusion in the manipulation member 30, contacts the full-opening-side stopper portion 19, a rotational angle of the manipulation member 30 is limited at an accelerator-full-opening position. The accelerator-full-opening position is a position, at which the amount of depression of the manipulation member 30 by the driver is in the full amount, i.e., the accelerator opening degree is 100% (full opening). The time of placing the manipulation member 30 in the accelerator-full-opening position will be referred to as the accelerator-full-opening time.

The first cover 16 and the second cover 18 are generally parallel to the bearing segment 13. The first cover 16 is configured into a rectangular plate form and is engaged to the second cover 18 such that the first cover 16 contacts an end portion of the top segment 14, an end portion of the rear segment 15 and an end portion of the front segment 17, which are opposite from the bearing segment 13. The first cover 16 limits intrusion of foreign objects into the internal space 11.

The second cover 18 is configured into a triangular plate form and is fixed with bolts 186 to the end portion of the rear segment 15 and the end portion of the front segment 17, which are opposite from the bearing segment 13. A recess, which rotatably supports the other end portion 202 of the shaft 20, is formed in an inner wall of the second cover 18. Specifically, the inner wall of the recess forms a bearing 180, which rotatably supports the other end portion 202 of the shaft 20. Recesses and projections, which are configured into a mesh pattern, are formed in an outer wall of the second cover 18 to maintain the resistance of the second cover 18 against an external force applied to the second cover 18. The second cover 18 limits intrusion of foreign objects into the internal space 11.

The shaft 20 extends in a horizontal direction (a left-to-right direction of the vehicle) at the lower side of the accelerator apparatus 1. A sensor receiving recess 22 is formed in the one end portion 201 of the shaft 20 to receive a sensing device of the rotational angle sensor 40.

The shaft 20 is rotatable through a predetermined angular range from the accelerator-full-closing position to an accelerator-full-opening position in response to a torque, which is applied from the manipulation member 30 upon depressing of the manipulation member 30 by a foot of the driver. The accelerator-full-closing position is a position, at which the amount of depression of the manipulation member 30 by the foot of the driver is zero, i.e., the accelerator opening degree is 0% (full closing). The time of placing the manipulation member 30 in the accelerator-full-closing position will be referred to as the accelerator-full-closing time.

Hereinafter, the rotational direction of the manipulation member 30 from the accelerator-full-closing position shown in FIG. 2 toward the accelerator-full-opening position will be referred to an accelerator opening direction. Furthermore, the rotational direction of the manipulation member 30 from the accelerator-full-opening position toward the accelerator-full-closing position will be referred to an accelerator closing direction.

The manipulation member 30 includes a rotatable body 38, the accelerator pedal 28 and a pedal arm 26. The rotatable body 38 includes a return boss portion 32, an arm connecting portion 34, a spring receiving portion 35 and a full-closing-side stopper portion 36, which are formed integrally.

The return boss portion 32 is configured into an annular form (i.e., a cylindrical tubular form) and is fixed to an outer peripheral wall of the shaft 20 by, for example, press-fitting at a location between the bearing segment 13 and the second cover 18. The return boss portion 32 serves as a first boss portion of the present disclosure.

First-bevel-gear teeth 321 are formed integrally with a side surface of the return boss portion 32, which is located on the second cover 18 side. The first-bevel-gear teeth 321 are arranged one after another at generally equal intervals in the circumferential direction. An axial projecting length of each of the first-bevel-gear teeth 321, which project toward a rotor 54 of the hysteresis mechanism 50, circumferentially progressively increases in the accelerator closing direction. Furthermore, a sloped surface is formed in a distal end part of each of the first-bevel-gear teeth 321 such that the sloped surface of each of the first-bevel-gear teeth 321 progressively approaches the rotor 54 in the accelerator closing direction.

A first friction member 323 is formed in a side surface of the return boss portion 32, which is located on the housing 12 side. The first friction member 323 is configured into an annular form and is placed between the return boss portion 32 and the inner wall of the bearing segment 13 at a corresponding location that is on a radially outer side of the shaft 20. When the return boss portion 32 is urged in a direction away from the rotor 54, i.e., in a direction toward the bearing segment 13, the return boss portion 32 frictionally engages the first friction member 323. A frictional force between the return boss portion 32 and the first friction member 323 acts as a rotational resistance against the return boss portion 32.

One end part of the arm connecting portion 34 is connected to an outer surface of the return boss portion 32, which is located at a radially outer side, and the other end part of the arm connecting portion 34 extends to the outside of the support member 10 through the communication hole 111.

The full-closing-side stopper portion 36 extends from the spring receiving portion 35 toward the upper side in the internal space 11. The full-closing-side stopper portion 36 serves as a limiting portion. When the full-closing-side stopper portion 36 contacts an inner wall 151 of the rear segment 15 upon releasing of the pedal 28, the rotation of the pedal 28 (serving as a depressible portion) in the accelerator closing direction is limited at the accelerator-full-closing position.

The spring receiving portion 35 is formed as a projection in the full-closing-side stopper portion 36, which extends from the return boss portion 32, such that the spring receiving portion 35 projects from the full-closing-side stopper portion 36 on the front segment 17 side of the full-closing-side stopper portion 36. The spring receiving portion 35 forms a return spring engaging surface 353 that serves as a first engaging surface, to which one end portion 391 of the return spring 39 is engaged. Details of the spring receiving portion 35 will be described later.

As shown in FIG. 1, one end portion of the pedal arm 26 is fixed to the arm connecting portion 34, and the other end portion of the pedal arm 26 downwardly extends toward the ground (the lower side). The other end portion of the pedal arm 26 is connected to the pedal 28. The pedal 28 converts the pedal force of the driver into a rotational torque, which is exerted about a rotational axis $\phi 1$ of the shaft 20, and this rotational torque is conducted to the shaft 20 through the rotatable body 38.

When the pedal 28 is rotated in the accelerator opening direction upon depression of the pedal 28 with the foot of the driver of the vehicle, a rotational angle of the shaft 20 in the accelerator opening direction relative to the accelerator-full-closing position, which serves as a reference point, is increased. Thereby, the accelerator opening degree, which corresponds to this rotational angle, is also increased. Furthermore, when the pedal 28 is rotated in the accelerator closing direction, the rotational angle of the shaft 20 is reduced, and thereby the accelerator opening degree is reduced.

The return spring 39 is formed as a coil spring. The return spring 39, which serves as a first coil spring, urges the manipulation member 30 in the accelerator closing direction. The urging force, which is exerted from the return spring 39 to the manipulation member 30, is increased when the rotational angle of the manipulation member 30, i.e., the rotational angle of the shaft 20 is increased. Furthermore, this urging force is set to enable returning of the manipulation member 30 and the shaft 20 to the accelerator-full-closing position regardless of the rotational position of the manipulation member 30.

The rotational angle sensor 40 includes a yoke 42, two permanent magnets (the permanent magnets having different polarities, respectively) 44, 46 and a Hall element 48. The yoke 42 is made of a magnetic material and is configured into a tubular form. The yoke 42 is fixed to an inner wall of the sensor receiving recess 22 of the shaft 20. The magnets 44, 46 are placed on the radially inner side of the yoke 42 and are fixed to the inner wall of the yoke 42 such that the magnets 44, 46 are opposed to each other about the rotational axis $\phi 1$ of the shaft 20. The Hall element 48 is placed between the magnet 44 and the magnet 46. The rotational angle sensor 40 serves as a rotational angle sensing device (a rotational angle sensing means) of the present disclosure.

When a magnetic field is applied to the Hall element 48, through which an electric current flows, a voltage is generated in the Hall element 48. This phenomenon is referred to as a Hall effect. A density of a magnetic flux, which penetrates through the Hall element 48, changes when the shaft 20 and the magnets 44, 46 are rotated about the rotational axis $\phi 1$ of the shaft 20. A value of the voltage discussed above is substantially proportional to the density of the magnetic flux, which penetrates through the Hall element 48. The rotational angle sensor 40 senses the relative rotational angle between the Hall element 48 and the magnets 44, 46, i.e., the relative rotational angle of the shaft 20 relative to the support member 10 by sensing the voltage, which is generated in the Hall element 48. The rotational angle sensor 40 transmits an electrical signal, which indicates the sensed rotational angle, to the external electronic control device (not shown) through an external connector 49 that is provided in the upper part of the accelerator apparatus 1.

The hysteresis mechanism 50 includes a rotor 54, a second friction member 58 and a hysteresis spring 59.

The rotor 54 is provided between the return boss portion 32 and the inner wall of the second cover 18 at a location, which is on a radially outer side of the shaft 20. The rotor 54 serves as a second boss portion and is configured into an annular form. The rotor 54 is rotatable relative to the shaft 20 and the return boss portion 32 and can be moved toward or away from the boss portion 32. Second-bevel-gear teeth 541 are formed integrally with a side surface of the rotor 54, which is located on the boss portion 32 side. The second-bevel-gear teeth 541 are arranged one after another at generally equal intervals in the circumferential direction. An axial projecting length of each of the second-bevel-gear teeth 541, which project toward the return boss portion 32, circumferentially progressively increases in the accelerator opening direction. Furthermore, a sloped surface is formed in a distal end part of each of the second-bevel-gear teeth 541 such that the sloped surface of each of the second-bevel-gear teeth 541 progressively approaches the rotor 54 in the accelerator opening direction.

When each of the first-bevel-gear teeth 321 contacts the corresponding one of the second-bevel-gear teeth 541 in the circumferential direction, the rotation can be transmitted between the return boss portion 32 and the rotor 54. That is, the rotation of the return boss portion 32 in the accelerator opening direction can be transmitted to the rotor 54 thorough the first-bevel-gear teeth 321 and the second-bevel-gear teeth 541. Furthermore, the rotation of the rotor 54 in the accelerator closing direction can be transmitted to the boss portion 32 through the second-bevel-gear teeth 541 and the first-bevel-gear teeth 321.

Furthermore, the sloped surface of each of the first-bevel-gear teeth 321 and the sloped surface of the corresponding one of the second-bevel-gear teeth 541 are engaged with each other and displace the return boss portion 32 and the rotor 54 away from each other when the rotational position of the return boss portion 32 is on the accelerator-full-opening position side of the accelerator-full-closing position. At this time, the first-bevel-gear teeth 321 urge the return boss portion 32 toward the housing 12 by the urging force, which increases when the rotational angle of the return boss portion 32 from the accelerator-full-closing position is increased. Furthermore, the second-bevel-gear teeth 541 urge the return boss portion 32 toward the second cover 18 by the urging force, which increases when the rotational angle of the return boss portion 32 from the accelerator-full-closing position is increased.

The second friction member 58 is configured into an annular form and is placed between the rotor 54 and the inner wall of the second cover 18 on the radially outer side of the shaft 20. When the rotor 54 is urged in the direction away from the return boss portion 32, i.e., in the direction toward the second cover 18, the rotor 54 is frictionally engaged with the second friction member 58. The frictional force between the rotor 54 and the second friction member 58 acts as a rotational resistance force (or simply referred to as a rotational resistance) against the rotation of the rotor 54. The second friction member 58 serves as a friction member of the present disclosure.

The hysteresis spring 59 is formed as a coil spring. The hysteresis spring 59 serves as a second coil spring of the present disclosure. One end portion 591 of the hysteresis spring 59 is engaged with an engaging portion 52, which is formed in an upper portion of the rotor 54. Furthermore, the other end portion 592 of the hysteresis spring 59, which is opposite from the one end portion 591, is engaged with a hysteresis spring engaging surface 172 that is formed in an inner wall of the front segment 17. The hysteresis spring 59 urges the rotor 54 in the accelerator closing direction. The urging force of the hysteresis spring 59 is increased when the rotational angle of the rotor 54 is increased. The torque, which is applied to the rotor 54 by the urging force of the hysteresis spring 59, is conducted to the return boss portion 32 through the second-bevel-gear teeth 541 and the first-bevel-gear teeth 321.

The engaging portion 52 includes an arm 55 and a spring receiving member 56. The arm 55 is formed integrally with the rotor 54. The spring receiving member 56 is supported by a distal end part of the arm 55, which is located on the front segment 17 side.

The spring receiving member 56 is made of a resin material and is configured into a dish-shaped body. The spring receiving member 56 includes a recessed portion 561 and a peripheral edge portion 562. The peripheral edge portion 562 is formed along an opening of a recess of the recessed portion 561. A distal end portion of the arm 55, which is located on the front segment 17 side, is inserted into the recess of the recessed portion 561 through the opening of the recessed portion 561 and contacts an inner wall surface of the recessed portion 561. Thereby, in the state where the spring receiving member 56 is supported by the distal end portion of the arm 55, the orientation of the recessed portion 561 and the peripheral edge portion 562 of the spring receiving member 56 can be freely changed. Also, the one end portion 591 of the hysteresis spring 59 is engaged with a hysteresis spring engaging surface 563 of the peripheral edge portion 562, which is located on the front segment 17 side. The hysteresis spring engaging surface 563 is held generally parallel to the hysteresis spring engaging surface 172 of the front segment 17 during the operational period, which is from the accelerator-full-closing time to the accelerator-full-opening time. In this way, a second center line L2 of the hysteresis spring 59 is held straight during the operational period, which is from the accelerator-full-closing time to the accelerator-full-opening time.

Here, the configuration of the spring receiving portion 35 and the configuration of the return spring 39 have the characteristic features. These features will be described in detail with reference to FIGS. 4A and 4B.

Figure 2:
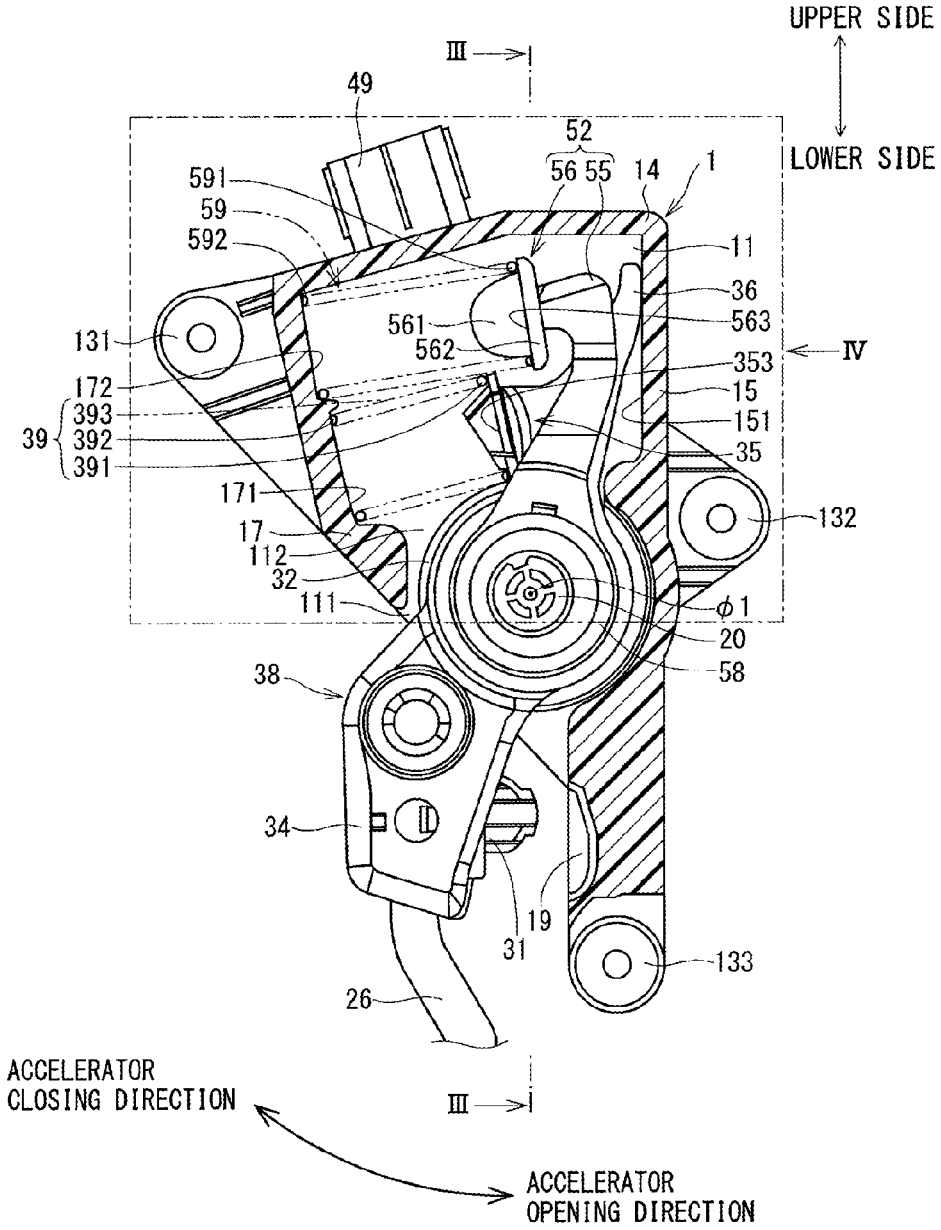
FIG. 2 is a cross-sectional view of the accelerator apparatus of the first embodiment taken along line II-II in FIG. 3.
Figure 3:
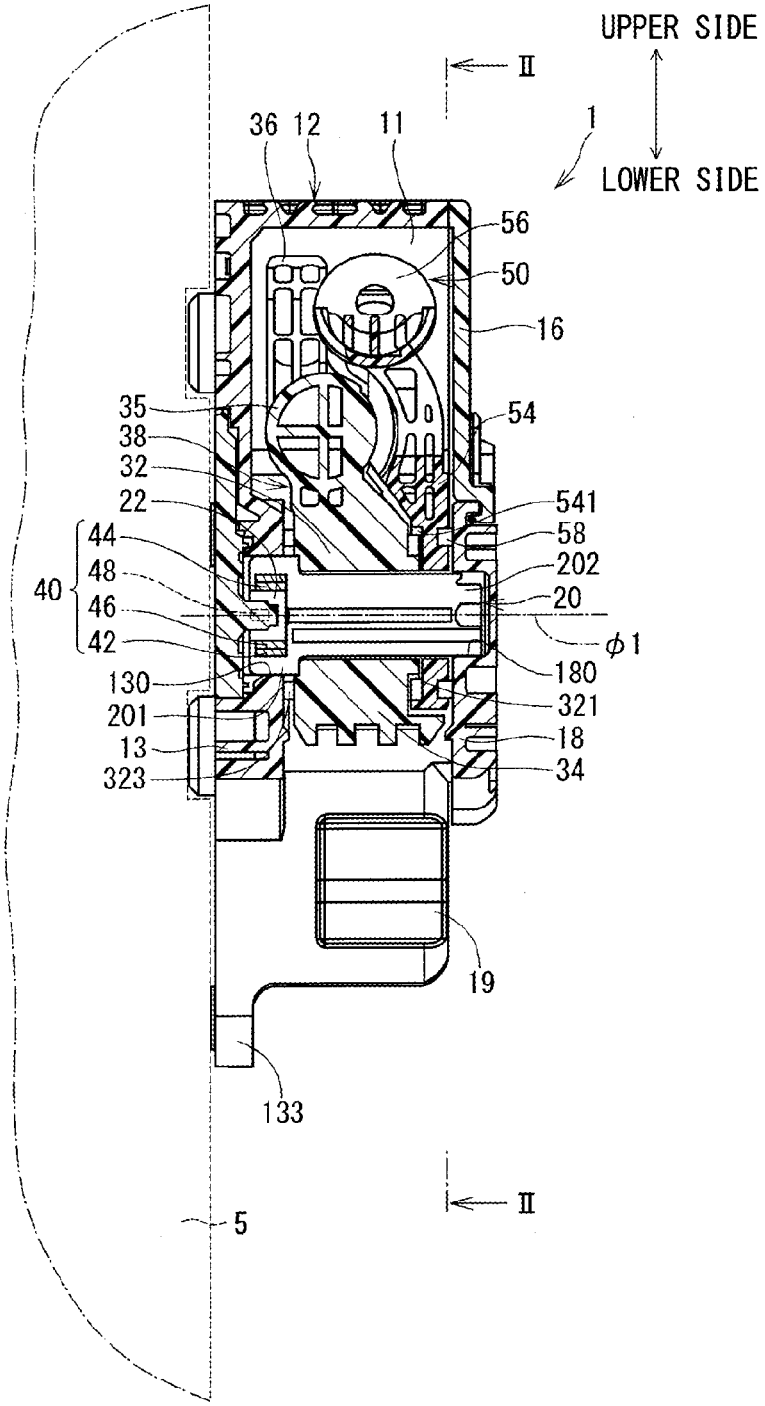
FIG. 3 is a cross-sectional view taken along line III-III in FIG. 2.
Figure 4A:
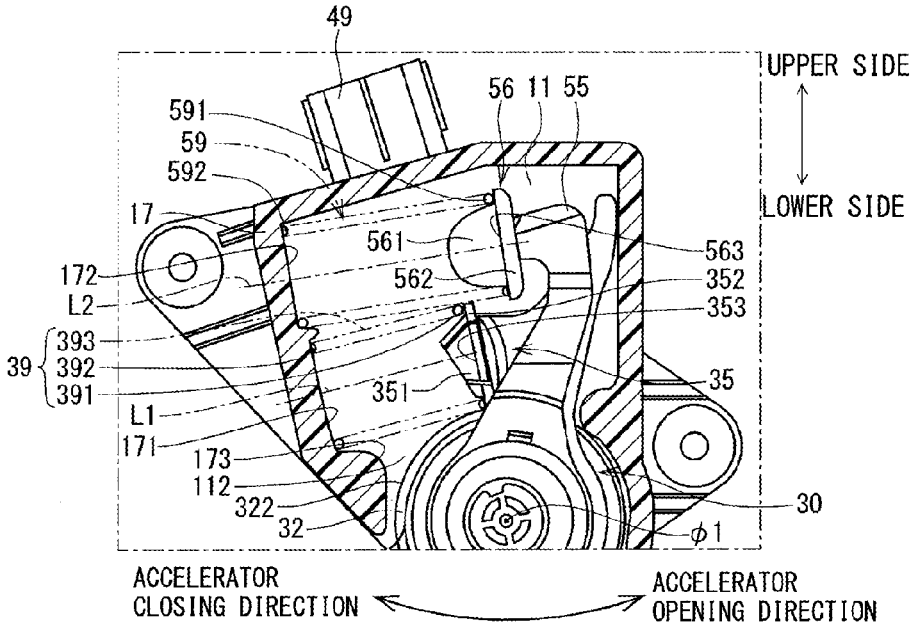
FIG. 4A is a partial view of an area IV in FIG. 2, showing one operational state of the accelerator apparatus of the first embodiment.
Figure 4B:
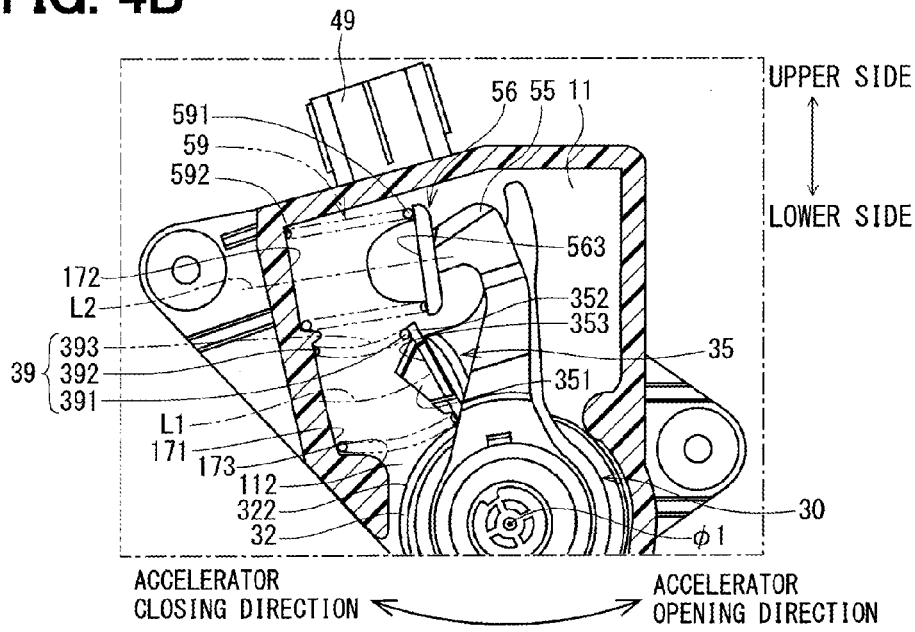
FIG. 4B is another partial view of the area IV in FIG. 2, showing another operational state of the accelerator apparatus of the first embodiment.

FIGS. 4A and 4B are schematic diagrams showing the area IV in FIG. 2, which depicts the important feature of the return spring 39. Specifically, FIG. 4A is a diagram showing the important feature of the return spring 39 at the accelerator-full-closing time. Furthermore, FIG. 4B is a diagram showing the important feature of the return spring 39 at the accelerator-full-opening time.

The spring receiving portion 35 includes a projection 351 and a peripheral edge portion 352. The peripheral edge portion 352 is formed on the rear segment 15 side of the projection 351. The projection 351 is configured generally into a circular truncated cone shape. A width of an upper side part of an outer peripheral surface of the projection 351 is wider than a width of a lower side part of the outer peripheral surface of the projection 351. Furthermore, the outer peripheral surface of the projection 351 is tilted from the upper side to the lower side, such that a distance between the outer peripheral surface of the projection 351 to the peripheral edge portion 352 is decreased from the upper side to the lower side of the projection 351. The return spring engaging surface 353 is formed in a part of the peripheral edge portion 352, which is located on the front segment 17 side.

The one end portion 391 of the return spring 39 is engaged with the return spring engaging surface 353, and the other end portion 392 of the return spring 39, which is opposite from the one end portion 391, is engaged with a return spring engaging surface 171. The return spring engaging surface 171 serves as a second engaging surface and is formed in the inner wall of the front segment 17. The return spring engaging surface 353 and the return spring engaging surface 171 are configured such that the return spring engaging surface 353 and the return spring engaging surface 171 are generally parallel to each other at the accelerator-full-closing time, as shown in FIG. 4A. The two end portions 391, 392 of the return spring 39 are perpendicularly engaged with the return spring engaging surface 353 and the return spring engaging surface 171, respectively, so that a first center line L1 of the return spring 39 is held straight at the accelerator-full-closing time, as shown in FIG. 4A.

When the manipulation member 30 is rotated in the accelerator opening direction, the return spring engaging surface 353 is rotated about the rotational axis ϕ1 in the accelerator opening direction. At this time, the return spring engaging surface 353 approaches the front segment 17, i.e., is moved toward the front segment 17, so that the return spring engaging surface 353 is directed further downward in comparison to the accelerator-full-closing time. Specifically, a plane of the return spring engaging surface 353 is further rotated about the rotational axis ϕ1 away from an imaginary line, which extends in the top-to-bottom direction of the accelerator apparatus 1 in FIG. 4B through the rotational axis ϕ, toward the front segment 17 in comparison to the accelerator-full-closing time. When the spring receiving portion 35 is rotated in the accelerator opening direction, the return spring 39 is compressed. Thereby, the first center line L1 is convexly curved in the radially inner direction of the rotational axis ϕ1 (i.e., the radial direction toward the rotational axis ϕ1), as shown in FIG. 4B. At this time, a main body 393 of the return spring 39 is bent into a dead space 112, which is a space that is not involved in the rotation of the manipulation member 30, i.e., a space that is not occupied by the manipulation member 30 throughout the rotational period from the accelerator-full-closing time to the accelerator-full-opening time. The dead space 112 is located on a lower side of the return spring 39 and is formed by an outer wall surface 322 of the return boss portion 32 and an inner wall surface 173 of the front segment 17. That is, the first center line L1 is convexly curved into the dead space 112.

Next, the operation of the accelerator apparatus 1 will be described.

When the accelerator pedal 28 is depressed by the foot of the driver, the manipulation member 30 is rotated together with the shaft 20 about the rotational axis ϕ1 in the accelerator opening direction in response to the pedal force of the driver applied to the accelerator pedal 28. At this time, in order to rotate the manipulation member 30 and the shaft 20, there is required a pedal force, which generates a torque that is larger than a sum of a torque, which is exerted by the urging force of the return spring 39 and the urging force of the hysteresis spring 59, and a resistance torque, which is exerted by the frictional force of the first friction member 232 and the frictional force of the second friction member 58.

When the pedal 28 is depressed, the resistance torque, which is exerted by the frictional force of the first friction member 323 and the frictional force of the second friction member 58, acts to limit the rotation of the pedal 28 in the accelerator opening direction. Therefore, the relationship between the pedal force and the rotational angle of the pedal 28 at the time of depressing the pedal 28 is such that the pedal force at the time of depressing the pedal 28 is larger than the pedal force at the time of releasing (i.e., returning) the pedal 28 even at the same rotational angle of the pedal 28.

In order to maintain the depressed state of the pedal 28, it is only required to apply the pedal force that generates the torque, which is larger than a difference between the torque generated by the urging forces of the return spring 39 and the hysteresis spring 59 and the resistance torque generated by the frictional forces of the first and second friction members 323, 58. In other words, when the driver wants to maintain the depressed state of the pedal 28 after depressing the pedal 28 to the desired position, the driver may reduce the applied pedal force by a certain amount. At the time of maintaining the depressed state of the pedal 28, the resistance torque, which is exerted by the frictional force of the first friction member 323 and the frictional force of the second friction member 58, acts to limit the rotation of the pedal 28 in the accelerator closing direction.

In order to return the pedal 28 toward the accelerator-full-closing position, the pedal force applied to the pedal 28 should generate a torque that is smaller than the difference between the torque, which is generated by the urging forces of the return spring 39 and the hysteresis spring 59, and the resistance torque, which is generated by the frictional forces of the first and second friction members 323, 58. Here, when the pedal 28 needs to be quickly returned to the accelerator-full-closing position, it is only required to stop the depressing of the pedal 28. Therefore, the burden on the driver of the vehicle is minimized. Thereby, when the depressed pedal 28 is returned toward the accelerator-full-closing position of the pedal 28, the burden on the driver is relatively small. At the time of returning the pedal 28, the resistance torque, which is exerted by the frictional force of the first friction member 323 and the frictional force of the second friction member 58, acts to limit the rotation of the pedal 28 in the accelerator closing direction.

In the case of the prior art accelerator apparatus, the return spring, which urges the manipulation member connected to the pedal, is arranged such that the return spring is convexly curved in the radially outer direction of the rotational axis of the manipulation member at the accelerator-full-closing time. For example, in the case where the return spring is placed on the upper side of the boss portion, the center portion of the return spring is convexly curved in the upward direction. Therefore, the support member, which receives the return spring, needs to have the longer length in the top-to-bottom direction (the vertical direction).

In contrast, in the accelerator apparatus 1 of the first embodiment, the return spring engaging surface 353 and the return spring engaging surface 171 are configured such that the return spring engaging surface 353 and the return spring engaging surface 171 are generally parallel to each other at the accelerator-full-closing time. The two end portions 391, 392 of the return spring 39 are held by the return spring engaging surface 353 and the return spring engaging surface 171, respectively, and the first center line L1 of the return spring 39 is straight at the accelerator-full-closing time. In this way, the length of the support member 10 of the accelerator apparatus 1 of the first embodiment in the top-to-bottom direction can be reduced in comparison to that of the support member of the prior art accelerator apparatus that has the return spring, which convexly curved in the radially outer direction of the rotational axis at the accelerator-full-closing time.

Furthermore, when the manipulation member 30 is rotated in the accelerator opening direction, the space between the return spring engaging surface 353 and the return spring engaging surface 171 at the lower side is increased in comparison to the accelerator-full-closing time. The first center line L1 of the return spring 39, which has the two end portions 391, 392 engaged with the return spring engaging surfaces 353, 171, is convexly curved toward the dead space 112 (in the radially inner direction of the rotational axis $\phi$1), so that the main body 393 of the return spring 39 is convexly curved into the dead space 112. In this way, it is not required to increase the size of the support member 10 in view of the deformation of the return spring 39, and thereby the length of the support member 10 of the accelerator apparatus 1 of the first embodiment in the top-to-bottom direction can be reduced in comparison to that of the support member of the prior art accelerator apparatus that has the return spring, which is convexly curved in the radially outer direction of the rotational axis at the accelerator-full-closing time.

In the accelerator apparatus 1 of the first embodiment, the spring receiving member 56, to which the one end portion 591 of the hysteresis spring 59 is engaged, can freely change the direction (the orientation) of the recessed portion 561. In this way, the second center line L2 of the hysteresis spring 59 can be kept straight from the accelerator-full-closing time to the accelerator-full-opening time. Thus, the length of the support member 10 in the top-to-bottom direction can be reduced in comparison to the prior art accelerator apparatus.

Second Embodiment

Next, an accelerator apparatus according to a second embodiment of the present disclosure will be described with reference to FIG. 5. In the second embodiment, the shape of the return spring at the accelerator-full-closing time differs from that of the first embodiment. In the following description, components, which are similar to those of the first embodiment, will be indicated by the same reference numerals and will not be described further for the sake of simplicity.

Figure 5:
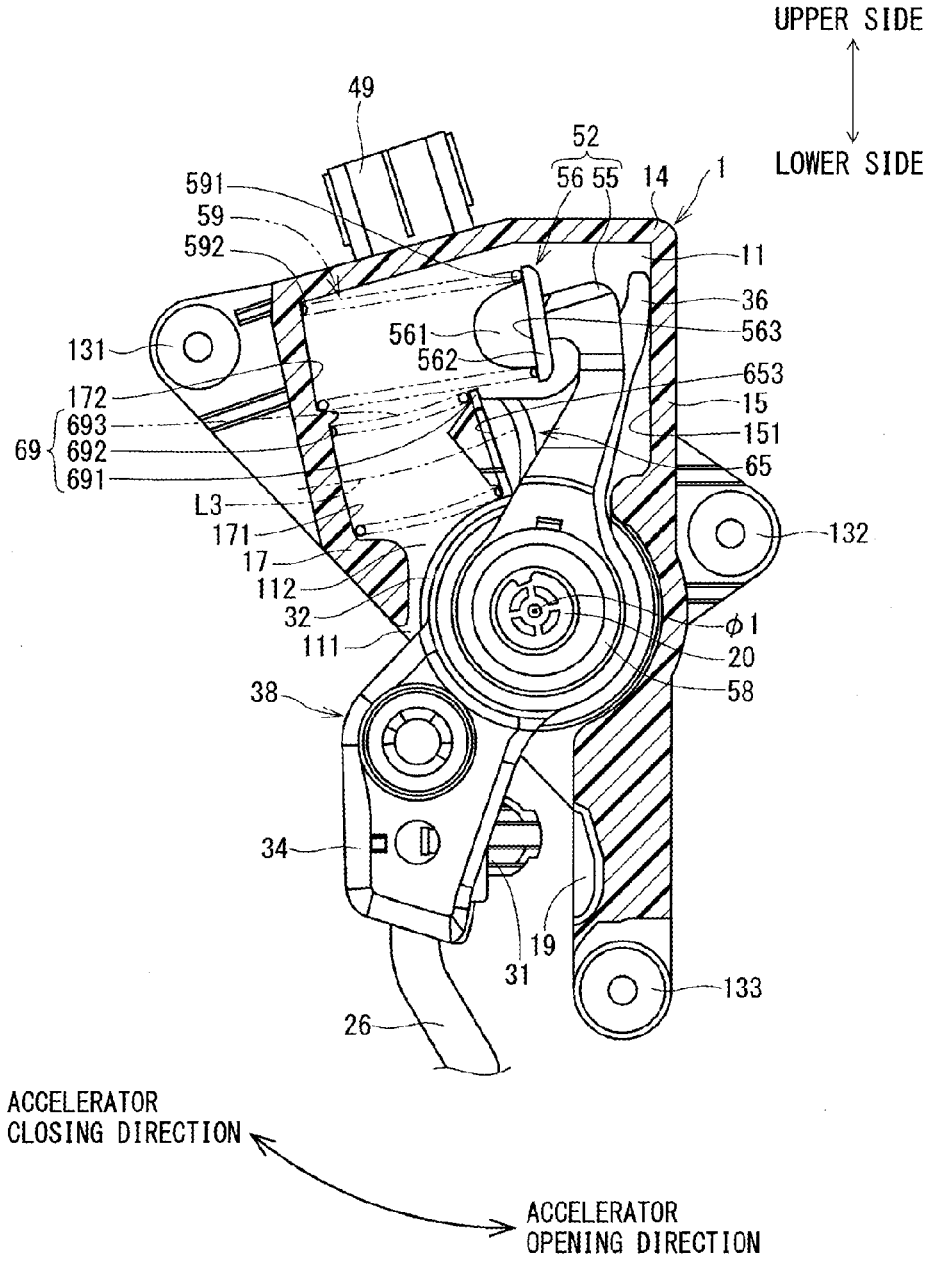
FIG. 5 is a cross-sectional view of an accelerator apparatus according to a second embodiment of the present disclosure.

FIG. 5 shows a cross-sectional area of the accelerator apparatus of the second embodiment.

The spring receiving portion 65 projects toward the front segment 17 at the full-closing-side stopper portion 36, which extends from the return boss portion 32. The spring receiving portion 65 forms a return spring engaging surface 653, to which one end portion 691 of a return spring 69 engages.

While the one end portion 691 of the return spring 69 is engaged with the return spring engaging surface 653 of the return spring receiving portion 65, the other end portion 692 of the return spring 69, which is opposite from the one end portion 691, is engaged with the return spring engaging surface 171 of the front segment 17. The return spring engaging surface 653 and the return spring engaging surface 171 are configured such that the return spring engaging surface 653 and the return spring engaging surface 171 extend along two sides, respectively, of an inverted V-shape at the accelerator-full-closing time, as shown in FIG. 5. Specifically, the return spring engaging surface 653 and the return spring engaging surface 171 are configured such that at the accelerator-full-closing time, a circumferential distance between a radially outer end of the return spring engaging surface 653 and a radially outer end of the return spring engaging surface 171, which are located at the radially outer side in the radial direction of the rotational axis $\phi$1 of the shaft 20, is shorter than a circumferential distance between a radially inner end of the return spring engaging surface 653 and a radially inner end of the return spring engaging surface 171, which are located at the radially inner side in the radial direction of the rotational axis $\phi$1 of the shaft 20. A first center line L3 of the return spring 69, which have the two end portions 691, 692, respectively engaged with the return spring engaging surfaces 653, 171, is convexly curved in the radially inner direction of the rotational axis $\phi$1 at the accelerator-full-closing time.

When the manipulation member 30 is rotated in the accelerator opening direction, the return spring 69 is compressed, so that the first center line L3 is further convexly curved in the radially inner direction of the rotational axis $\phi$1. At this time, a main body 693 of the return spring 69 is deformed, i.e., is bent into the dead space 112.

In the accelerator apparatus 1 of the second embodiment, the return spring engaging surface 653 and the return spring engaging surface 171 are configured such that the circumferential distance between the radially outer end of the return spring engaging surface 653 and the radially outer end of the return spring engaging surface 171 is shorter than the circumferential distance between the radially inner end of the return spring engaging surface 653 and the radially inner end of the return spring engaging surface 171 at the accelerator-full-closing time. Furthermore, the first center line L3 of the return spring 69 is convexly curved in the radially inner direction of the rotational axis $\phi$1 at the accelerator-full-closing time.

When the manipulation member 30 is rotated in the accelerator opening direction, the first center line L3 of the return spring 69 is further convexly curved in the radially inner direction of the rotational axis ϕ1. In this way, the accelerator apparatus 1 of the second embodiment achieves the advantages, which are similar to those of the first embodiment.

Now, modifications of the above embodiments will be described.

(a) In the first embodiment, the return spring engaging surface of the spring receiving portion and the return spring engaging surface of the front segment are generally parallel to each other at the accelerator-full-closing time. Furthermore, in the second embodiment, the return spring engaging surface of the spring receiving portion and the return spring engaging surface of the front segment are angled such that the circumferential distance between the radially outer end of the return spring engaging surface of the spring receiving portion and the radially outer end of the return spring engaging surface of the front segment is shorter than the circumferential distance between the radially inner end of the return spring engaging surface of the spring receiving portion and the radially inner end of the return spring engaging surface of the front segment at the accelerator-full-closing time. However, the positional relationship between the return spring engaging surface of the spring receiving portion and the return spring engaging surface of the front segment is not limited to the above relationships and may be changed to any other suitable relationship.

(b) In the above embodiments, the accelerator apparatus has the hysteresis mechanism. However, it may not be necessary to have the hysteresis mechanism in the accelerator apparatus.

The present disclosure is not limited to the above embodiments, and the above embodiments may be modified within the spirit and scope of the present disclosure.

What is claimed is:

1. An accelerator apparatus for a vehicle, comprising:

a support member that is installable to a body of the vehicle;

a shaft that is supported by the support member and is rotatable in an accelerator opening direction and an accelerator closing direction, which are opposite to each other;

a first boss portion that is fixed to an outer peripheral wall of the shaft and is rotatable integrally with the shaft;

a depressible portion that is connected to the first boss portion and is depressible by a driver of the vehicle;

a limiting portion that is connected to the first boss portion, wherein the limiting portion limits a rotational angle of the shaft in the accelerator closing direction when the limiting portion contacts the support member;

a rotational angle sensing device that senses the rotational angle of the shaft relative to the support member;

a first coil spring that urges the shaft in the accelerator closing direction; and a hysteresis mechanism that changes a required pedal force between a time of increasing an amount of depression of the depressible portion and a time of decreasing the amount of depression of the depressible portion and includes:

a second boss portion that is laced on a radially outer side of the shaft and is rotatable relative to the first boss portion;

a friction member that is placed between the second boss portion and the support member;

a second coil spring that urges the second boss portion in the accelerator closing direction and is placed adjacent to the first coil spring on one side of the first coil spring, which is opposite from the shaft in a radial direction of the shaft; and an engaging portion, to which one end portion of the second coil spring is engaged, wherein:

the support member has a space that is located on another side of the first coil spring, which is opposite from the one side of the first coil spring in the radial direction of the shaft and at which the shaft is placed;

a first center line of the first coil spring is convexly curved in the space toward the shaft when the shaft is rotated in the accelerator opening direction; and the first center line is straight or is convexly curved toward the space when the limiting portion contacts the support member.

2. The accelerator apparatus according to claim 1, wherein:

one end portion of the first coil spring is engaged with a first engaging surface;

the other end portion of the first coil spring, which is opposite from the one end portion of the first coil spring, is engaged with a second engaging surface; and when the limiting portion contacts the support member, the first engaging surface and the second engaging surface are opposed to each other and are generally parallel to each other.

3. The accelerator apparatus according to claim 1, wherein when the limiting portion contacts the support member, a second center line of the second coil spring is held straight.

4. An accelerator apparatus for a vehicle, comprising:

a support member that is installable to a body of the vehicle;

a shaft that is supported by the support member and is rotatable in an accelerator opening direction and an accelerator closing direction, which are opposite to each other;

a first boss portion that is fixed to an outer peripheral wall of the shaft and is rotatable integrally with the shaft;

a depressible portion that is connected to the first boss portion and is depressible by a driver of the vehicle;

a limiting portion that is connected to the first boss portion, wherein the limiting portion limits a rotational angle of the shaft in the accelerator closing direction when the limiting portion contacts the support member;

a rotational angle sensing device that senses the rotational angle of the shaft relative to the support member;

a first coil spring that urges the shaft in the accelerator closing direction; and a hysteresis mechanism that changes a required pedal force between a time of increasing an amount of depression of the depressible portion and a time of decreasing the amount of depression of the depressible portion and includes:

a second boss portion that is placed on a radially outer side of the shaft and is rotatable relative to the first boss portion;

a friction member that is placed between the second boss portion and the support member;

a second coil spring that urges the second boss portion in the accelerator closing direction; and an engaging portion, to which one end portion of the second coil spring is engaged, wherein:

the support member has a space, in which a first center line of the first coil spring is convexly curved when the shaft is rotated in the accelerator opening direction;

the first center line is straight or is convexly curved toward the space when the limiting portion contacts the support member; and when the limiting portion contacts the support member, a second center line of the second coil spring is held straight.

5. The accelerator apparatus according to claim 4, wherein:

one end portion of the first coil spring is engaged with a first engaging surface;

the other end portion of the first coil spring, which is opposite from the one end portion of the first coil spring, is engaged with a second engaging surface; and when the limiting portion contacts the support member, the first engaging surface and the second engaging surface are opposed to each other and are generally parallel to each other.

6. The accelerator apparatus according to claim 4, wherein when the limiting portion contacts the support member, the first center line is convexly curved toward the space.

* * * * *